US011646515B1

(12) United States Patent
Mutnury et al.

(10) Patent No.: US 11,646,515 B1
(45) Date of Patent: May 9, 2023

(54) CONNECTION ASSEMBLY FOR AN INFORMATION HANDLING SYSTEM

(71) Applicant: Dell Products L.P., Round Rock, TX (US)

(72) Inventors: Bhyrav M. Mutnury, Austin, TX (US); Mark A. Smith, Georgetown, TX (US); Sanjiv C. Sinha, Austin, TX (US); Sandor Farkas, Round Rock, TX (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 17/451,708

(22) Filed: Oct. 21, 2021

(51) Int. Cl.
*H01R 12/58* (2011.01)
*H01R 12/53* (2011.01)
*H01R 12/73* (2011.01)

(52) U.S. Cl.
CPC ..... *H01R 12/58* (2013.01); *H01R 12/53* (2013.01); *H01R 12/737* (2013.01)

(58) Field of Classification Search
CPC ..... H01R 12/58; H01R 12/53; H01R 12/737
See application file for complete search history.

(56) References Cited

U.S. PATENT DOCUMENTS 4,894,031 A * 1/1990 Damon ..... H05K 13/003 439/82
5,154,621 A * 10/1992 Legrady ..... H01R 12/58 439/82
5,486,124 A * 1/1996 Wandler ..... H01R 13/18 439/843
10,374,340 B2 * 8/2019 Cook ..... A61B 5/6858
2013/0017739 A1 * 1/2013 Glick ..... H01R 13/187 439/842
2014/0120760 A1 * 5/2014 Zieman ..... H01R 12/91 29/874
2016/0181706 A1 * 6/2016 Nakano ..... H01R 13/111 439/877
2020/0028295 A1 * 1/2020 Soubh ..... H01R 13/4223
2022/0140536 A1 * 5/2022 Siev ..... H01R 24/28 439/607.01

FOREIGN PATENT DOCUMENTS

JP 2016081734 A * 5/2016

* cited by examiner

*Primary Examiner* — Truc T Nguyen
(74) *Attorney, Agent, or Firm* — McDermott Will & Emery LLP

(57) ABSTRACT

A connection assembly, including: a first connector having a first end and a second end, and a first surface extending between the first end and the second end, the first connector including press fit pins extending away from the first surface, each of the press fit pins including: a rod portion; a connecting portion having a first shape; a second connector having a first end and a second end, including: a dielectric carrier having a first surface extending between the first end and the second end of the second connector, receptacles positioned within the first surface of the dielectric carrier, each of the receptacles including: a cylindrical region, a tapered region having a second shape that corresponds to the first shape of the connection portion, wherein, when the first connector is coupled to the second connector, the press fit pins are positioned within respective receptacles of the receptacles.

20 Claims, 7 Drawing Sheets

CONNECTION ASSEMBLY FOR AN INFORMATION HANDLING SYSTEM

BACKGROUND

Field of the Disclosure

The disclosure relates generally to an information handling system, and in particular, a connection assembly for an information handling system.

Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

As signal speeds continue to double every generation, the sensitivity to reflections, loss and crosstalk is getting higher. With the loss budget for high-speed interfaces roughly staying the same and their total length staying the same, it is getting more difficult to meet such speed requirements.

SUMMARY

Innovative aspects of the subject matter described in this specification may be embodied in a connection assembly for use in an information handling system, the connection assembly including: a first connector having a first end and a second end positioned opposite to the first end, and further having a first surface extending between the first end and the second end of the first connector, the first connector including a plurality of press fit pins extending away from the first surface, each of the press fit pins including: a rod portion; a connecting portion having a first shape; a second connector having a first end and a second end positioned opposite to the first end, the second connector including: a dielectric carrier having a first surface extending between the first end and the second end of the second connector, a plurality of receptacles positioned within the first surface of the dielectric carrier, each of the receptacles including: a cylindrical region, a tapered region having a second shape that corresponds to the first shape of the connection portion, wherein, when the first connector is coupled to the second connector, the plurality of press fit pins are positioned within respective receptacles of the plurality of receptacles.

Other embodiments of these aspects include corresponding systems and apparatus.

These and other embodiments may each optionally include one or more of the following features. For instance, when the plurality of press fit pins are positioned within respective receptacles of the plurality of receptacles, the connecting portion of each of the press fit pins is positioned within the tapered region of the respective receptacle such that the connecting portion of each of the press fit pins is in contact with the tapered region of the respective receptacle. When the plurality of press fit pins are positioned within respective receptacles of the plurality of receptacles, the connecting portion of each of the press fit pins are further positioned within the cylindrical region of the respective receptacle such that the connecting portion of each of the press fit pins are in further contact with the cylindrical region of the respective receptacle. Each of the receptacles includes a flared region, wherein the cylindrical region is positioned between the flared region and the tapered region. Each of the receptacles includes a keyed portion positioned within the flared region. The tapered region includes one or more slots such that when the connecting portion of each of the press fit pins is in contact with the tapered region of the respective receptacle, the tapered region expands at the slots. Each of the receptacles further includes a solder cup attached to the tapered region. The second connector further includes a connector housing surrounding the dielectric carrier. The first connector is further coupled to a cable. The second connector is further coupled to a cable.

The details of one or more embodiments of the subject matter described in this specification are set forth in the accompanying drawings and the description below. Other potential features, aspects, and advantages of the subject matter will become apparent from the description, the drawings, and the claims.

DESCRIPTION OF PARTICULAR EMBODIMENT(S)

Figure 1:
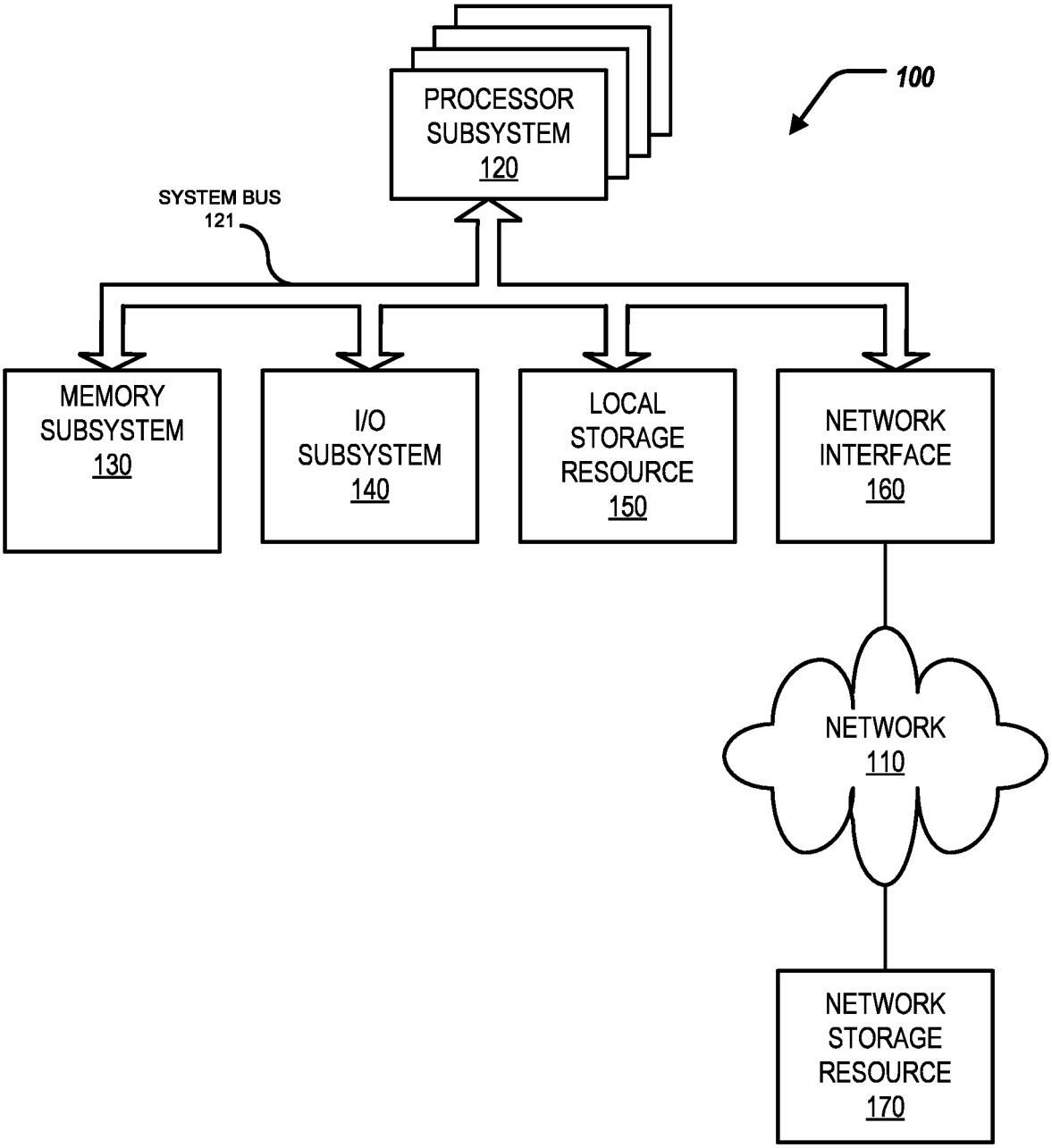
FIG. 1 is a block diagram of selected elements of an embodiment of an information handling system.

This disclosure discusses a connection assembly for an information handling system. In short, the information handling system can include a connection system, including a first connector with press fit pins and a second connector with receptacles. The first connector can be coupled to the second connector such that the press fit pins of the first connector are positioned within respective receptacles of the second connector.

Specifically, this disclosure discusses a connection assembly for use in an information handling system, the connection assembly including: a first connector having a first end and a second end positioned opposite to the first end, and further having a first surface extending between the first end and the second end of the first connector, the first connector including a plurality of press fit pins extending away from the first surface, each of the press fit pins including: a rod portion; a connecting portion having a first shape; a second connector having a first end and a second end positioned opposite to the first end, the second connector including: a dielectric carrier having a first surface extending between the first end and the second end of the second connector, a plurality of receptacles positioned within the first surface of the dielectric carrier, each of the receptacles including: a cylindrical region, a tapered region having a second shape that corresponds to the first shape of the connection portion, wherein, when the first connector is coupled to the second connector, the plurality of press fit pins are positioned within respective receptacles of the plurality of receptacles.

In the following description, details are set forth by way of example to facilitate discussion of the disclosed subject matter. It should be apparent to a person of ordinary skill in the field, however, that the disclosed embodiments are exemplary and not exhaustive of all possible embodiments.

For the purposes of this disclosure, an information handling system may include an instrumentality or aggregate of instrumentalities operable to compute, classify, process, transmit, receive, retrieve, originate, switch, store, display, manifest, detect, record, reproduce, handle, or utilize various forms of information, intelligence, or data for business, scientific, control, entertainment, or other purposes. For example, an information handling system may be a personal computer, a PDA, a consumer electronic device, a network storage device, or another suitable device and may vary in size, shape, performance, functionality, and price. The information handling system may include memory, one or more processing resources such as a central processing unit (CPU) or hardware or software control logic. Additional components of the information handling system may include one or more storage devices, one or more communications ports for communicating with external devices as well as various input and output (I/O) devices, such as a keyboard, a mouse, and a video display. The information handling system may also include one or more buses operable to transmit communication between the various hardware components.

For the purposes of this disclosure, computer-readable media may include an instrumentality or aggregation of instrumentalities that may retain data and/or instructions for a period of time. Computer-readable media may include, without limitation, storage media such as a direct access storage device (e.g., a hard disk drive or floppy disk), a sequential access storage device (e.g., a tape disk drive), compact disk, CD-ROM, DVD, random access memory (RAM), read-only memory (ROM), electrically erasable programmable read-only memory (EEPROM), and/or flash memory (SSD); as well as communications media such wires, optical fibers, microwaves, radio waves, and other electromagnetic and/or optical carriers; and/or any combination of the foregoing.

Particular embodiments are best understood by reference to FIGS. 1-6 wherein like numbers are used to indicate like and corresponding parts.

Turning now to the drawings, FIG. 1 illustrates a block diagram depicting selected elements of an information handling system 100 in accordance with some embodiments of the present disclosure. In various embodiments, information handling system 100 may represent different types of portable information handling systems, such as, display devices, head mounted displays, head mount display systems, smart phones, tablet computers, notebook computers, media players, digital cameras, 2-in-1 tablet-laptop combination computers, and wireless organizers, or other types of portable information handling systems. In one or more embodiments, information handling system 100 may also represent other types of information handling systems, including desktop computers, server systems, controllers, and microcontroller units, among other types of information handling systems. Components of information handling system 100 may include, but are not limited to, a processor subsystem 120, which may comprise one or more processors, and system bus 121 that communicatively couples various system components to processor subsystem 120 including, for example, a memory subsystem 130, an I/O subsystem 140, a local storage resource 150, and a network interface 160. System bus 121 may represent a variety of suitable types of bus structures, e.g., a memory bus, a peripheral bus, or a local bus using various bus architectures in selected embodiments. For example, such architectures may include, but are not limited to, Micro Channel Architecture (MCA) bus, Industry Standard Architecture (ISA) bus, Enhanced ISA (EISA) bus, Peripheral Component Interconnect (PCI) bus, PCI-Express bus, HyperTransport (HT) bus, and Video Electronics Standards Association (VESA) local bus.

As depicted in FIG. 1, processor subsystem 120 may comprise a system, device, or apparatus operable to interpret and/or execute program instructions and/or process data, and may include a microprocessor, microcontroller, digital signal processor (DSP), application specific integrated circuit (ASIC), or another digital or analog circuitry configured to interpret and/or execute program instructions and/or process data. In some embodiments, processor subsystem 120 may interpret and/or execute program instructions and/or process data stored locally (e.g., in memory subsystem 130 and/or another component of information handling system). In the same or alternative embodiments, processor subsystem 120 may interpret and/or execute program instructions and/or process data stored remotely (e.g., in network storage resource 170).

Also in FIG. 1, memory subsystem 130 may comprise a system, device, or apparatus operable to retain and/or retrieve program instructions and/or data for a period of time (e.g., computer-readable media). Memory subsystem 130 may comprise random access memory (RAM), electrically erasable programmable read-only memory (EEPROM), a PCMCIA card, flash memory, magnetic storage, opto-magnetic storage, and/or a suitable selection and/or array of volatile or non-volatile memory that retains data after power to its associated information handling system, such as system 100, is powered down.

In information handling system 100, I/O subsystem 140 may comprise a system, device, or apparatus generally operable to receive and/or transmit data to/from/within information handling system 100. I/O subsystem 140 may represent, for example, a variety of communication interfaces, graphics interfaces, video interfaces, user input interfaces, and/or peripheral interfaces. In various embodiments, I/O subsystem 140 may be used to support various peripheral devices, such as a touch panel, a display adapter, a keyboard, an accelerometer, a touch pad, a gyroscope, an IR sensor, a microphone, a sensor, or a camera, or another type of peripheral device.

Local storage resource 150 may comprise computer-readable media (e.g., hard disk drive, floppy disk drive, CD-ROM, and/or other type of rotating storage media, flash memory, EEPROM, and/or another type of solid state storage media) and may be generally operable to store instructions and/or data. Likewise, the network storage resource may comprise computer-readable media (e.g., hard disk drive, floppy disk drive, CD-ROM, and/or other type of rotating storage media, flash memory, EEPROM, and/or other type of solid state storage media) and may be generally operable to store instructions and/or data.

In FIG. 1, network interface 160 may be a suitable system, apparatus, or device operable to serve as an interface between information handling system 100 and a network 110. Network interface 160 may enable information handling system 100 to communicate over network 110 using a suitable transmission protocol and/or standard, including, but not limited to, transmission protocols and/or standards enumerated below with respect to the discussion of network 110. In some embodiments, network interface 160 may be communicatively coupled via network 110 to a network storage resource 170. Network 110 may be a public network or a private (e.g. corporate) network. The network may be implemented as, or may be a part of, a storage area network (SAN), personal area network (PAN), local area network (LAN), a metropolitan area network (MAN), a wide area network (WAN), a wireless local area network (WLAN), a virtual private network (VPN), an intranet, the Internet or another appropriate architecture or system that facilitates the communication of signals, data and/or messages (generally referred to as data). Network interface 160 may enable wired and/or wireless communications (e.g., NFC or Bluetooth) to and/or from information handling system 100.

In particular embodiments, network 110 may include one or more routers for routing data between client information handling systems 100 and server information handling systems 100. A device (e.g., a client information handling system 100 or a server information handling system 100) on network 110 may be addressed by a corresponding network address including, for example, an Internet protocol (IP) address, an Internet name, a Windows Internet name service (WINS) name, a domain name or other system name. In particular embodiments, network 110 may include one or more logical groupings of network devices such as, for example, one or more sites (e.g. customer sites) or subnets. As an example, a corporate network may include potentially thousands of offices or branches, each with its own subnet (or multiple subnets) having many devices. One or more client information handling systems 100 may communicate with one or more server information handling systems 100 via any suitable connection including, for example, a modem connection, a LAN connection including the Ethernet or a broadband WAN connection including DSL, Cable, T1, T3, Fiber Optics, Wi-Fi, or a mobile network connection including GSM, GPRS, 3G, or WiMax.

Network 110 may transmit data using a desired storage and/or communication protocol, including, but not limited to, Fibre Channel, Frame Relay, Asynchronous Transfer Mode (ATM), Internet protocol (IP), other packet-based protocol, small computer system interface (SCSI), Internet SCSI (iSCSI), Serial Attached SCSI (SAS) or another transport that operates with the SCSI protocol, advanced technology attachment (ATA), serial ATA (SATA), advanced technology attachment packet interface (ATAPI), serial storage architecture (SSA), integrated drive electronics (IDE), and/or any combination thereof. Network 110 and its various components may be implemented using hardware, software, or any combination thereof.

In short, the information handling system 100 can include a connection system, including a first connector with press fit pins and a second connector with receptacles. The first connector can be coupled to the second connector such that the press fit pins of the first connector are positioned within respective receptacles of the second connector.

Figure 2:
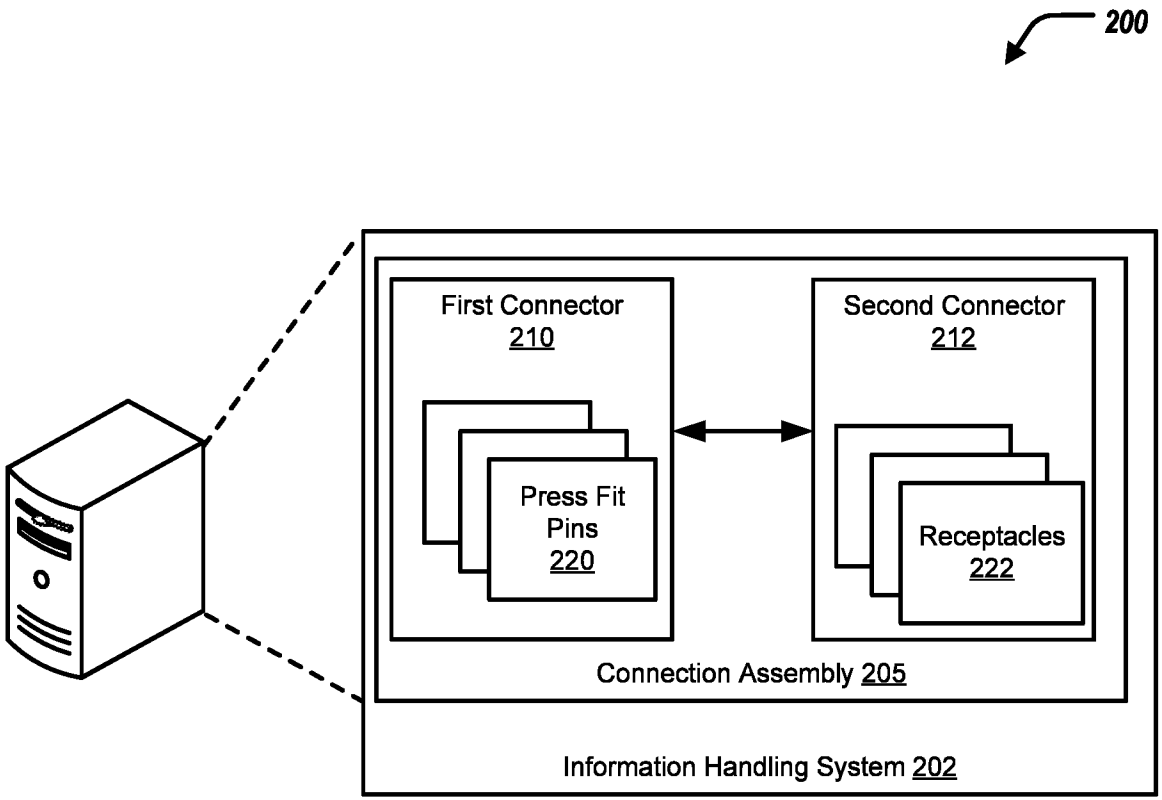
FIG. 2 illustrates a block diagram of an information handling system including a connection assembly.

Turning to FIG. 2, FIG. 2 illustrates an environment 200 including an information handling system 202. The information handling system 202 can include a connection assembly 205, the connection assembly 205 including a first connector 210 and a second connector 212. In some examples, the information handling system 202 is similar to, or includes, the information handling system 100 of FIG. 1.

The first connector 210 can include a plurality of press fit pins 220. The second connector can include a plurality of receptacles 222.

Figure 3A:
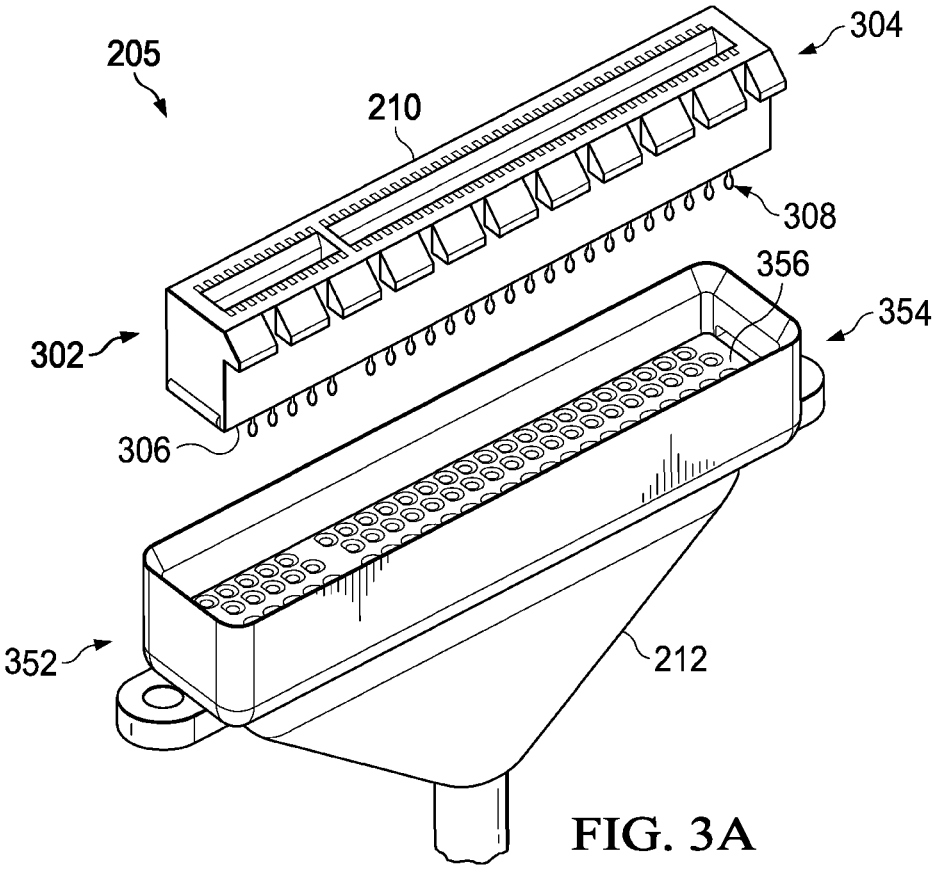
FIGS. 3A-3D illustrates the connection assembly.
Figure 3B:
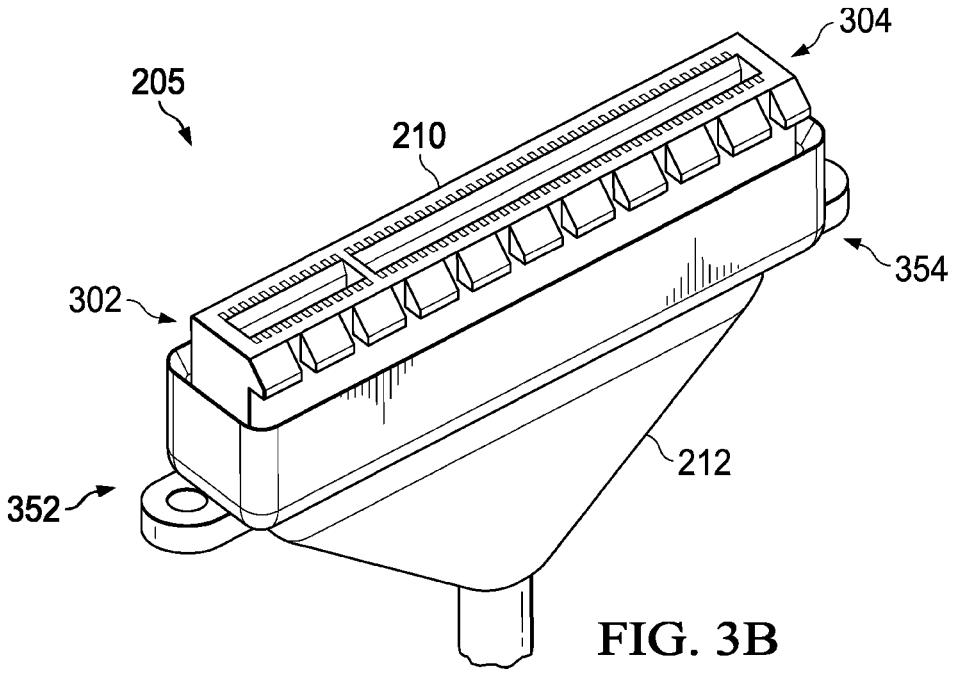
Figure 3C:
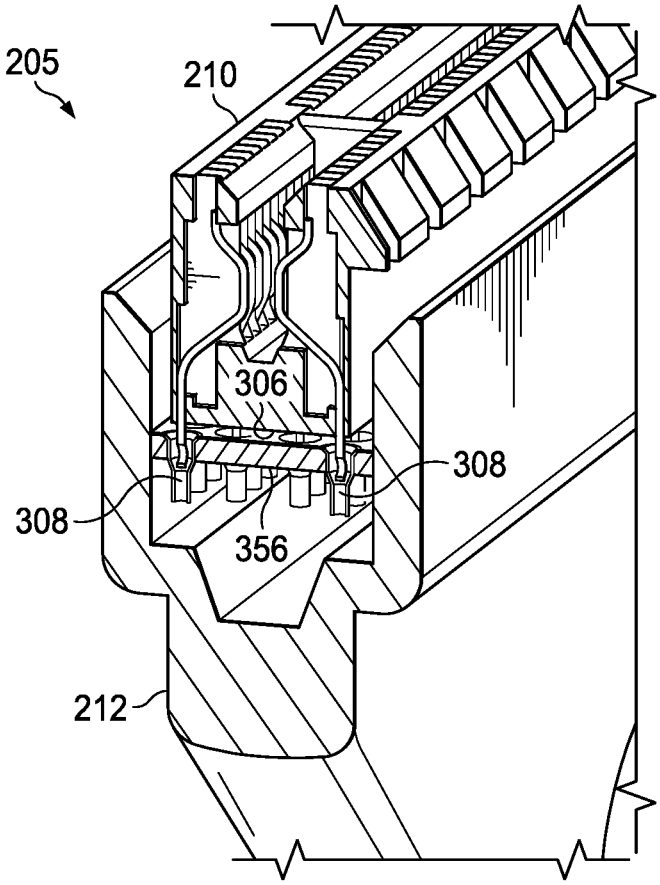
Figure 3D:
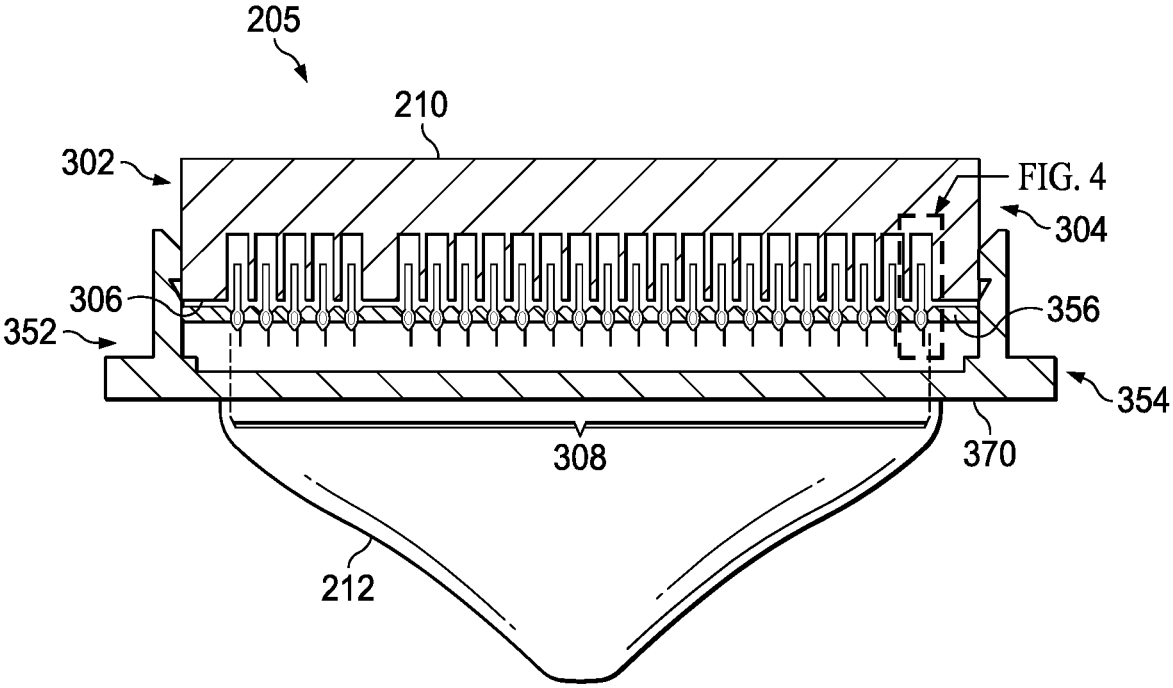

FIG. 3A illustrates the connection assembly 205, and in particular, a perspective view of the first connector 210 decoupled from the second connector 212. FIG. 3B illustrates the connection assembly 205, and in particular, a perspective view of the first connector 210 coupled to the second connector 212. FIG. 3C illustrates the connection assembly 205, and in particular, a cutaway perspective view of the connection assembly 204. FIG. 3D illustrates the connections assembly 205, and in particular, a side cutaway view of the connection assembly 204.

Referring to FIGS. 3A-3D, the first connector 210 can include a first end 302 and a second end 304 positioned opposite to the first end 302. The first connector 210 can include a first surface 306 extending between the first end 302 and the second end 304. The first connector 210 can include a plurality of press fit pins 308 extending away from the first surface 306. The plurality of press fit pins 308 are similar to the press fit pins 220 of FIG. 2.

Figure 4:
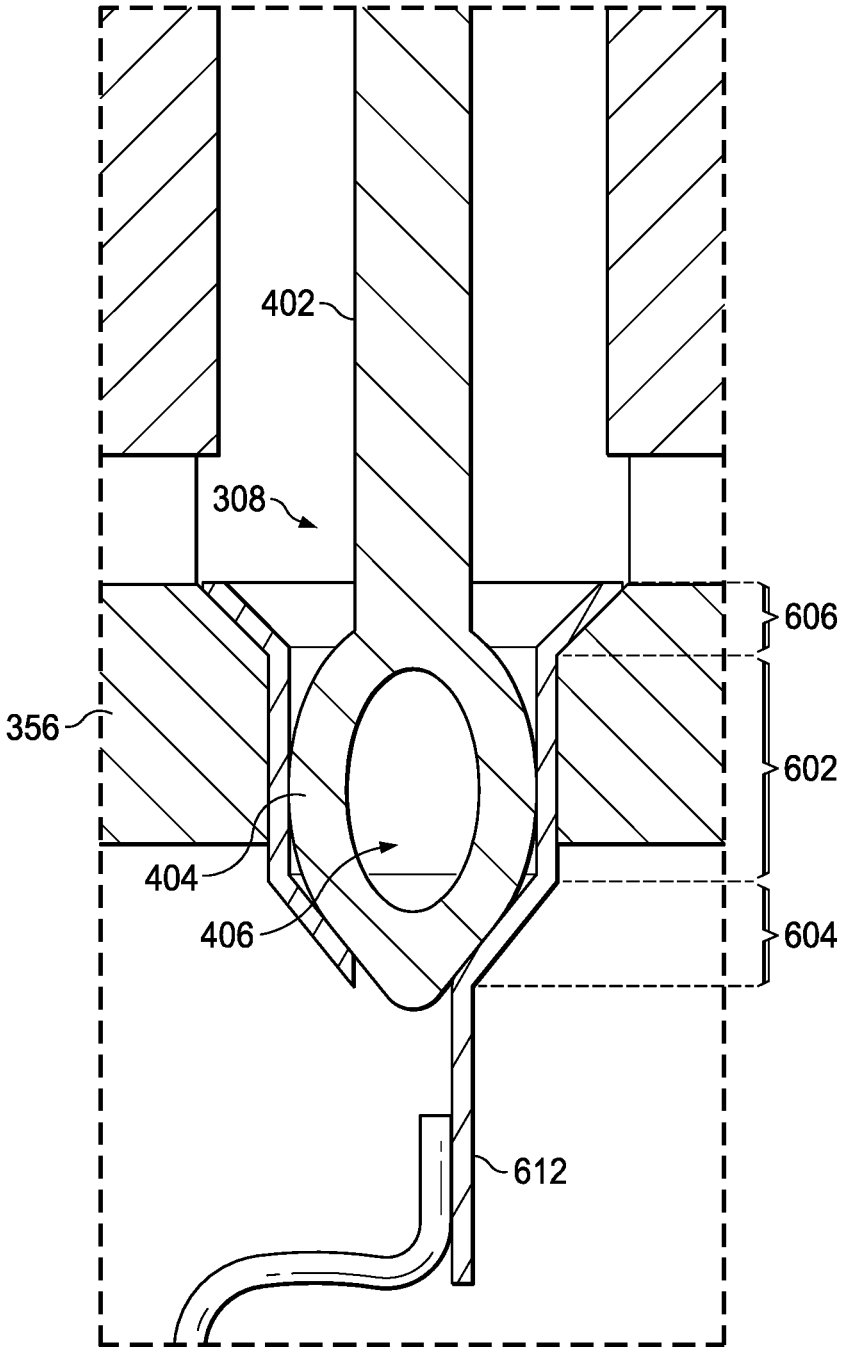
FIG. 4 illustrates a press fit pin coupled with a receptacle of the connection assembly.

FIG. 4 illustrates a close-up of one of the press fit pins 308 of FIG. 3D. In particular, each of the press fit pins 308 can include a rod portion 402 and a connection portion 404 connected to the rod portion 402. The connection portion 404 can have a first shape. For example, the connection portion 404 can have an ovoid (oval) based shape; however other geometries are possible depending on the application desired. The connection portion 404 can be solid, or include a hollow region 406.

In some examples, the first connector 210 can be coupled to a cable (not shown). The cable can be connected to one or more other computing elements of the information handling system 202, such as a printed circuit board (PCB).

Referring back to FIGS. 3A-3D, the second connector 212 can include a first end 352 and a second end 354 positioned opposite to the first end 352. The second connector 212 can include a back side 370. The second connector 212 can include a dielectric carrier 356.

Figure 5A:
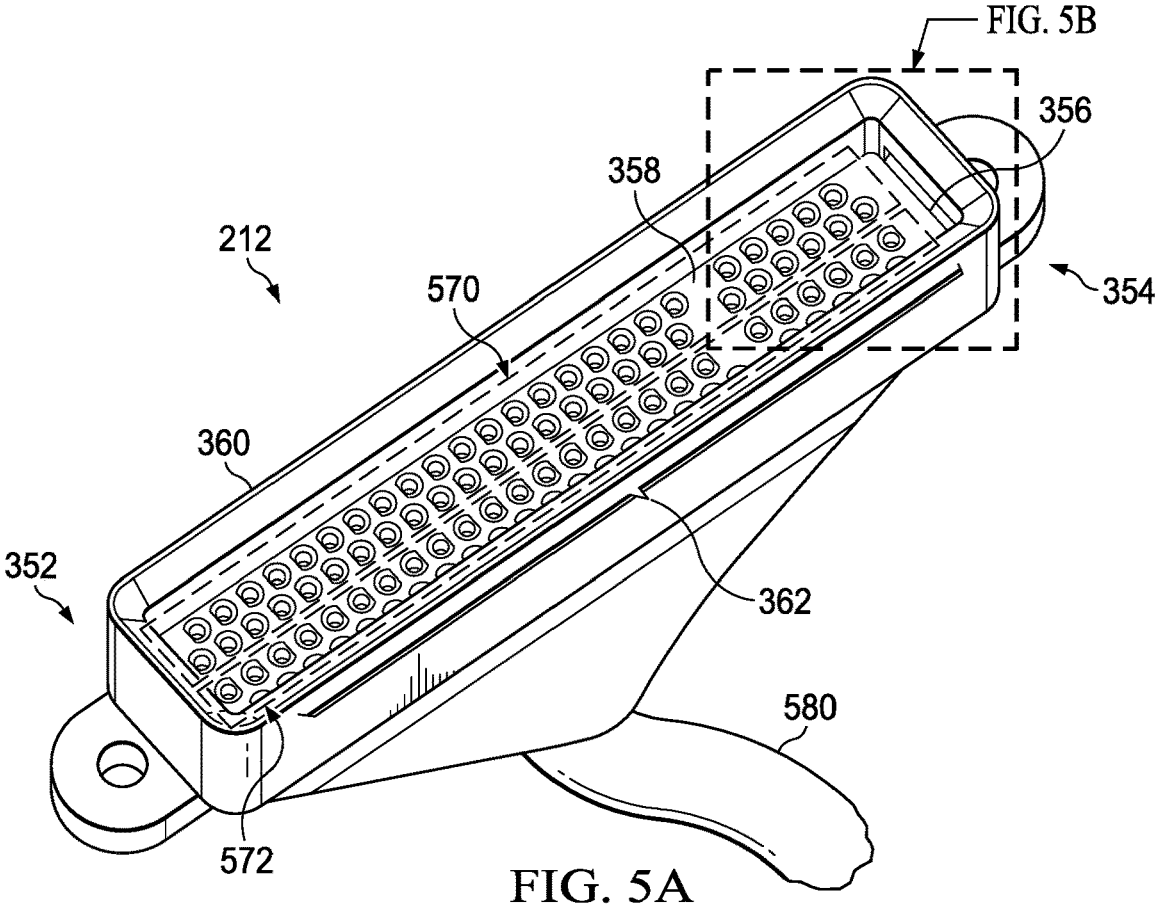
FIGS. 5A, 5B illustrate a second connector of the connection assembly.
Figure 5B:
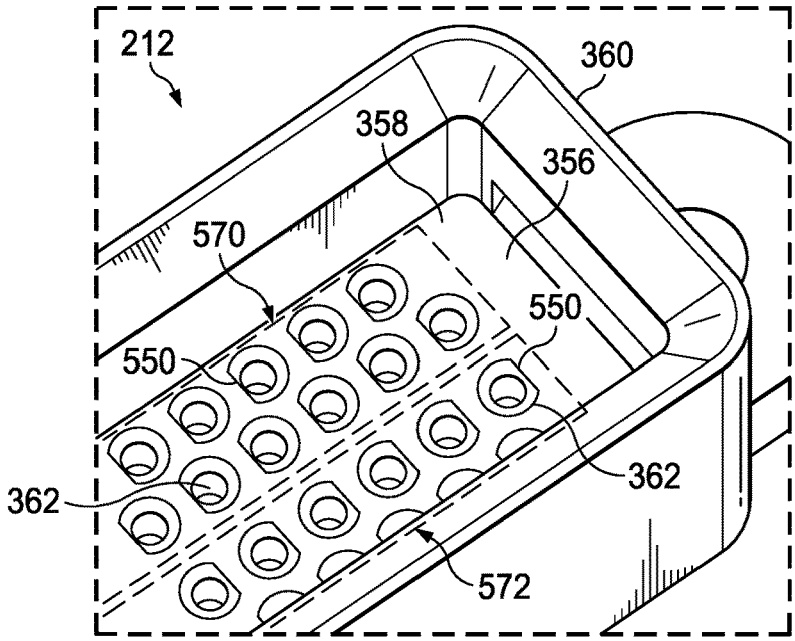

Referring to FIGS. 5A, 5B, FIG. 5A illustrates a perspective view of the second connector 212; and FIG. 5B illustrates a close-up view of the second connector 212. The dielectric carrier 356 can include a first surface 358 extending between the first end 352 and the second end 354 of the second connector 212. The second connector 212 can further include a connector housing 360 surrounding the dielectric carrier 356.

The second connector 212 can further include a plurality of receptacles 362 positioned within the first surface 358 of the dielectric carrier 356. The plurality of receptacles 362 are similar to the receptacles 222 of FIG. 1.

Figure 6A:
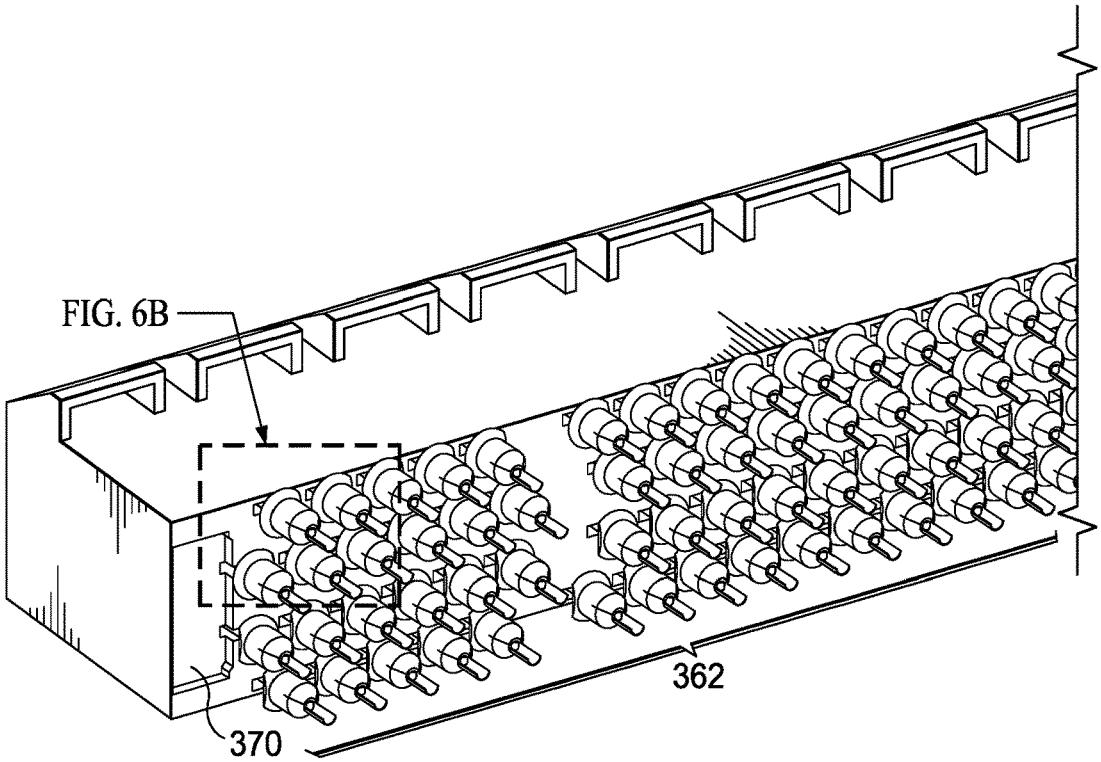
FIGS. 6A, 6B illustrate the receptacles of the second connector of the connection assembly.
Figure 6B:
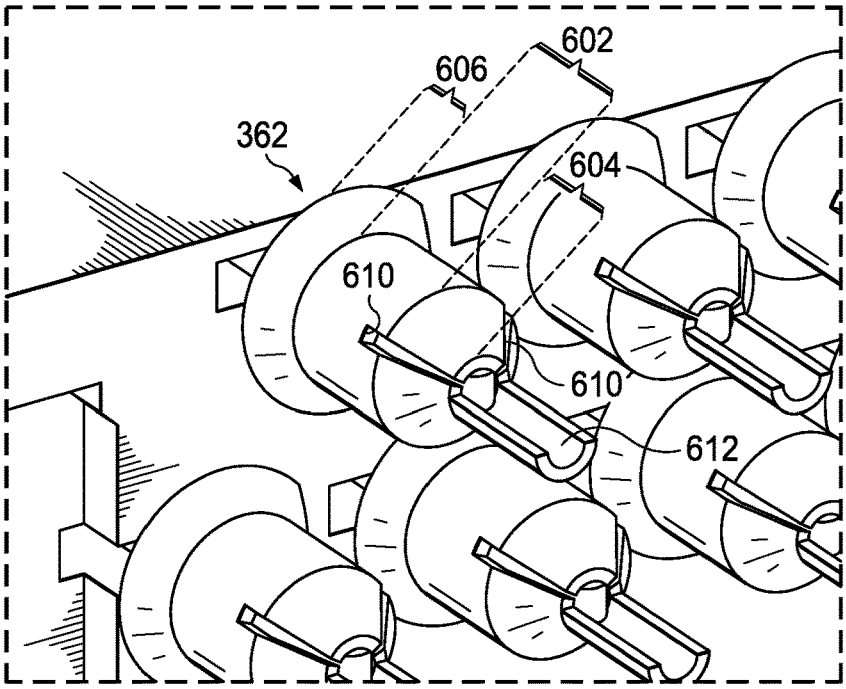

Referring to FIGS. 6A, 6B, FIG. 6A illustrates a wire-frame view of the second connector 212, and in particular, a wire-frame view of the back side 370 of the second connector 212. FIG. 6B illustrates a close up view of a particular receptacle 362 of FIG. 6A. Referring to FIGS. 4 and 6B, each of the receptacles 362 can include a cylindrical region 602, a tapered region 604, and a flared region 606. The cylindrical region 602 is positioned between the flared region 606 and the tapered region 604.

The tapered region 604 can have a second shape. The second shape of the tapered region 604 can correspond to the first shape of the connection portion 404 of the press fit pins 308. For example, when the first shape of the connection portion 404 includes an ovoid based shape, the second shape of the tapered region 604 can correspond to such an ovoid based shape such that the connection portion 404 can contact the tapered region 604 when the press fit pin 308 is coupled to the receptacle 362, described further herein. The tapered region 604 can include one or more slots 610.

Each of the receptacles 362 can further include a solder cup 612 attached to the tapered region 604. The solder cup 612 provides direct wire soldering.

Referring to FIGS. 4, 5A, 5B, and 6B, each of the receptacles 362 can include a keyed portion 550 positioned within the flared region 606. In some examples, the keyed portion 550 of a first set 570 of the receptacles 362 can be positioned in a first orientation, and the keyed portion 550 of a second set 572 of the receptacles 362 can be in a second orientation. For example, the first orientation can be opposite to the second orientation. For example, the keyed portion 550 of the first set 570 of the receptacles 362 can be aligned with the first end 352 of the second connector 212; and the keyed portion 550 of the second set 572 of the receptacles 362 can be aligned with the second end 354 of the second connector 212. In some examples, the receptacles 362 can be asymmetrical as a result of the keyed portions 550. In some examples, the first set 570 of the receptacles 362 are in the first orientation and the second set 572 of the receptacles 362 are in the second orientation such that the solder cup 612 of each respective receptacle 362 are accessible (e.g., for soldering).

In some examples, the first connector 210 can be coupled/attached to the second connector 210, as shown in FIGS. 3B, 3C, 3D. When the first connector 210 is coupled to the second connector 212, the plurality of press fit pins 308 are positioned within respective receptacles 362. Specifically, referring to FIGS. 4 and 6B, when the press fit pins 308 are positioned with respective receptacles 362, the connecting portion 404 of each of the press fit pins 308 is positioned within the tapered region 604 of the respective receptacle 362 such that the connection portion 404 of each of the press fit pins 308 is in contact with the tapered region 604 of the respective receptacle 362. Furthermore, when the press fit pins 308 are positioned with respective receptacles 362, the connecting portion 404 of each of the press fit pins 308 is further positioned within the cylindrical region 602 of the respective receptacle 362 such that the connection portion 404 of each of the press fit pins 308 is in contact with the cylindrical region 602 of the respective receptacle 362.

Referring to FIG. 6B, in some examples, when the press fit pins 308 are positioned within respective receptacles 362, and in particular, when the connection portion 404 of each of the press fit pins 308 is in contact with the tapered region 604 and/or the cylindrical region 602, the tapered region 604 expands at the slots 610. That is, the slots 610 provide mechanical compliance for tolerances of the press fit pins 308. In other words, the tapered region 604 of the receptacles 362 can expand via the slots 610, e.g., when the size of the press fit pins 308 is larger than the size of the respective receptacle 362. Additionally, the expansion of the tapered region 604 of the receptacles 362 when the press fit pins 308 are positioned with in the respective receptacles 362 can facilitate contact between the press fit pins 308 and the respective receptacle 362.

In some examples, the keyed portions 550 of the receptacles 362 can facilitate alignment between the first connector 210 and the second connector 212 when the first connector 210 is coupled to the second connector 212 and the press fit pins 308 are positioned within respective receptacles 362. Thus, the press fit pins 308 in each subset 570, 572 are soldered in the same orientation when the first connector 210 is coupled to the second connector 212.

In some examples, the second connector 212 can be coupled to a cable 580, as shown in FIG. 5A.

In some examples, the first connector 210 can include receptacles (similar to the receptacles 362) and the second connector 212 can include press fit pins (similar to the press fit pins 308). Thus, the press fit pins of the second connector 212 can be positioned within respective receptacles of the first connector 210 when the first connector 210 is coupled to the second connector 212.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated other-wise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, features, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative.

What is claimed is:

1. A connection assembly for use in an information handling system, the connection assembly including:

a first connector having a first end and a second end positioned opposite to the first end, and further having a first surface extending between the first end and the second end of the first connector, the first connector including a plurality of press fit pins extending away from the first surface, each of the press fit pins including:

a rod portion;

a connecting portion having a first shape;

a second connector having a third end and a fourth end positioned opposite to the third end, the second connector including:

a dielectric carrier having a second surface extending between the third end and the fourth end of the second connector, a plurality of receptacles positioned within the second surface of the dielectric carrier, each of the receptacles including:

a cylindrical region, a tapered region having a second shape that corresponds to the first shape of the connection portion, wherein, when the first connector is coupled to the second connector, the plurality of press fit pins are positioned within respective receptacles of the plurality of receptacles.

2. The connection assembly of claim 1 wherein, when the plurality of press fit pins are positioned within respective receptacles of the plurality of receptacles, the connecting portion of each of the press fit pins is positioned within the tapered region of the respective receptacle such that the connecting portion of each of the press fit pins is in contact with the tapered region of the respective receptacle.

3. The connection assembly of claim 2, wherein, when the plurality of press fit pins are positioned within respective receptacles of the plurality of receptacles, the connecting portion of each of the press fit pins are further positioned within the cylindrical region of the respective receptacle such that the connecting portion of each of the press fit pins are in further contact with the cylindrical region of the respective receptacle.

4. The connection assembly of claim 1, wherein each of the receptacles includes a flared region, wherein the cylindrical region is positioned between the flared region and the tapered region.

5. The connection assembly of claim 4, wherein each of the receptacles includes a keyed portion positioned within the flared region.

6. The connection assembly of claim 2, wherein the tapered region includes one or more slots such that when the connecting portion of each of the press fit pins is in contact with the tapered region of the respective receptacle, the tapered region expands at the slots.

7. The connection assembly of claim 1, wherein each of the receptacles further includes a solder cup attached to the tapered region.

8. The connection assembly of claim 1, wherein the second connector further includes a connector housing surrounding the dielectric carrier.

9. The connection assembly of claim 1, wherein the first connector is further coupled to a cable.

10. The connection assembly of claim 1, wherein the second connector is further coupled to a cable.

11. An information handling system, including:

a processor;

memory media storing instructions executable by the processor to perform operations;

a connection assembly, including:

a first connector having a first end and a second end positioned opposite to the first end, and further having a first surface extending between the first end and the second end of the first connector, the first connector including a plurality of press fit pins extending away from the first surface, each of the press fit pins including:

a rod portion;

a connecting portion having a first shape;

a second connector having a third end and a fourth end positioned opposite to the third end, the second connector including:

a dielectric carrier having a second surface extending between the third end and the fourth end of the second connector, a plurality of receptacles positioned within the second surface of the dielectric carrier, each of the receptacles including:

a cylindrical region, a tapered region having a second shape that corresponds to the first shape of the connection portion, wherein, when the first connector is coupled to the second connector, the plurality of press fit pins are positioned within respective receptacles of the plurality of receptacles.

12. The information handling system of claim 11 wherein, when the plurality of press fit pins are positioned within respective receptacles of the plurality of receptacles, the connecting portion of each of the press fit pins is positioned within the tapered region of the respective receptacle such that the connecting portion of each of the press fit pins is in contact with the tapered region of the respective receptacle.

13. The information handling system of claim 12, wherein, when the plurality of press fit pins are positioned within respective receptacles of the plurality of receptacles, the connecting portion of each of the press fit pins are further positioned within the cylindrical region of the respective receptacle such that the connecting portion of each of the press fit pins are in further contact with the cylindrical region of the respective receptacle.

14. The information handling system of claim 11, wherein each of the receptacles includes a flared region, wherein the cylindrical region is positioned between the flared region and the tapered region.

15. The information handling system of claim 14, wherein each of the receptacles includes a keyed portion positioned within the flared region.

16. The information handling system of claim 12, wherein the tapered region includes one or more slots such that when the connecting portion of each of the press fit pins is in contact with the tapered region of the respective receptacle, the tapered region expands at the slots.

17. The information handling system of claim 11, wherein each of the receptacles further includes a solder cup attached to the tapered region.

18. The information handling system of claim 11, wherein the second connector further includes a connector housing surrounding the dielectric carrier.

19. The information handling system of claim 11, wherein the first connector is further coupled to a cable.

20. The information handling system of claim 11, wherein the second connector is further coupled to a cable.

* * * * *